US007806715B2

(12) United States Patent
Zheng

(10) Patent No.: US 7,806,715 B2
(45) Date of Patent: Oct. 5, 2010

(54) CONNECTOR

(75) Inventor: Song Zheng, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 125 days.

(21) Appl. No.: 12/327,094

(22) Filed: Dec. 3, 2008

(65) Prior Publication Data

US 2009/0149054 A1 Jun. 11, 2009

(30) Foreign Application Priority Data

Dec. 5, 2007 (JP) ..... 2007-314190

(51) Int. Cl.
*H01R 13/627* (2006.01)

(52) U.S. Cl. ..... 439/352; 439/489

(58) Field of Classification Search ..... 439/488, 439/489, 352, 353, 354, 357, 358
See application file for complete search history.

(56) References Cited

U.S. PATENT DOCUMENTS

| | | | | |
|---|---|---|---|---|
| 5,595,499 | A * | 1/1997 | Zander et al. | 439/352 |
| 6,059,598 | A * | 5/2000 | Yamashita et al. | 439/352 |
| 6,692,288 | B2 | 2/2004 | Nimura | |
| 7,252,530 | B2 * | 8/2007 | Shamoto | 439/352 |
| 7,614,904 | B2 * | 11/2009 | Hiramatsu | 439/489 |
| 7,722,385 | B2 * | 5/2010 | Nakamura | 439/489 |
| 2009/0149054 | A1 * | 6/2009 | Zheng | 439/357 |

* cited by examiner

*Primary Examiner*—James Harvey
(74) *Attorney, Agent, or Firm*—Gerald E. Hespos; Michael J. Porco

(57) ABSTRACT

A slider (50) is mounted on a housing (20) movable between a wait position and a detection position. The slider (50), at the detection position, is at a position opposite to a flexing direction of a locking arm (26) to prevent the locking arm (26) from flexing in an unlocking direction. In a process of shifting the slider (50) from the wait position to the detection position, a guide portion (45) gradually displaces the slider (50) toward the detection position in a direction in which the degree of locking between the slider (50) and the locking arm (26) becomes higher. At the detection position, a detection piece (54) of the slider (50) takes a downwardly inclining posture at its front portion to press down a front portion of the locking arm (26) from above.

10 Claims, 13 Drawing Sheets

CONNECTOR

BACKGROUND OF THE INVENTION

1. Field of the Invention

The invention relates to a connector.

2. Description of the Related Art

U.S. Pat. No. 6,692,288 discloses a connector with a housing that has an elastically flexible locking arm for holding the connector in a fit-in state with a mating connector. A slider is mounted on the locking arm and is movable in the longitudinal direction of the locking arm between a wait position and a detection position. The slider is locked to the locking arm and is held at the wait position in the process of fitting the mating connector in the housing. The slider is unlocked from the locking arm and can move to the detection position when the mating connector is fit in the housing in the normal state. Therefore it is possible to know whether the normal fit-in position has been reached by checking whether the slider can be moved to the detection position.

The housing has a movement prevention portion. The front portion of the slider slips into the movement prevention portion and is locked thereto when the slider has reached the detection position. Thus, the slider is prevented from moving up, and the locking arm is prevented from elastically flexing in the unlocking direction.

The slider of the above-described connector is locked to the movement prevention portion almost simultaneously with the arrival of the slider at the detection position. Thus, there is a possibility that the slider will not be locked favorably to the movement prevention portion when the slider is displaced. Accordingly, the locking arm may flex accidentally in the unlocking direction when the slider is not locked correctly to the movement prevention portion and when the slider is locked to the locking arm in a small region or to a low extent.

The invention has been completed in view of the above-described situation, and it is an object of the invention to hold the locking state of a locking arm securely.

SUMMARY OF THE INVENTION

The invention relates to a connector with housing that has a locking arm. The locking arm flexes in a process of fitting a mating connector in the housing and elastically returns to an original state when the mating connector is fit normally in the housing. Thus, the locking arm holds the mating connector in a separation prevention state when the locking arm elastically returns to the original state. A slider is mounted on the housing and is movable between a wait position and a detection position. The slider is locked to the locking arm and is held at the wait position in a process of fitting the mating connector in the housing. However, the slider is unlocked from the locking arm and can move to the detection position when the mating connector is fit normally in the housing. The slider is opposed to a flexing direction of the locking arm when the slider is at the detection position to prevent the locking arm from elastically flexing in an unlocking direction. The housing has a guide that slides on the slider during a movement thereof and gradually displaces the slider to the detection position in a direction in which a degree of locking between the slider and the locking arm becomes higher. The guide allows a gradual increase in the degree of the locking between the slider and the locking arm as the slider moves to the detection position. Therefore the slider is guided correctly to the detection position. Further it is possible to hold the locking state securely and firmly between the locking arm and the locking projection The slider preferably has an elastically flexible detection piece. A front portion of the detection piece inclines down at the detection position and presses the locking arm down. Therefore it is possible to hold the locking state more securely and firmly between the locking arm and a locking projection.

The housing has a prevention portion that engages the slider when the slider has reached the detection position to prevent the slider from moving up and to prevent the locking arm from elastically flexing in the unlocking direction. The prevention portion and the guide are continuous with each other. Thus, the slider can be shifted smoothly from the prevention portion to the guide. Furthermore, the prevention portion can prevent inadvertent elastic flexure of the locking arm.

The housing has a protection wall for covering a front of the slider when the slider is at the wait position. Thus, it is possible to prevent the slider from being damaged by a foreign matter that interferes with the slider and from moving inadvertently to the detection position.

DETAILED DESCRIPTION OF THE PREFERRED EMBODIMENTS

Figure 1:
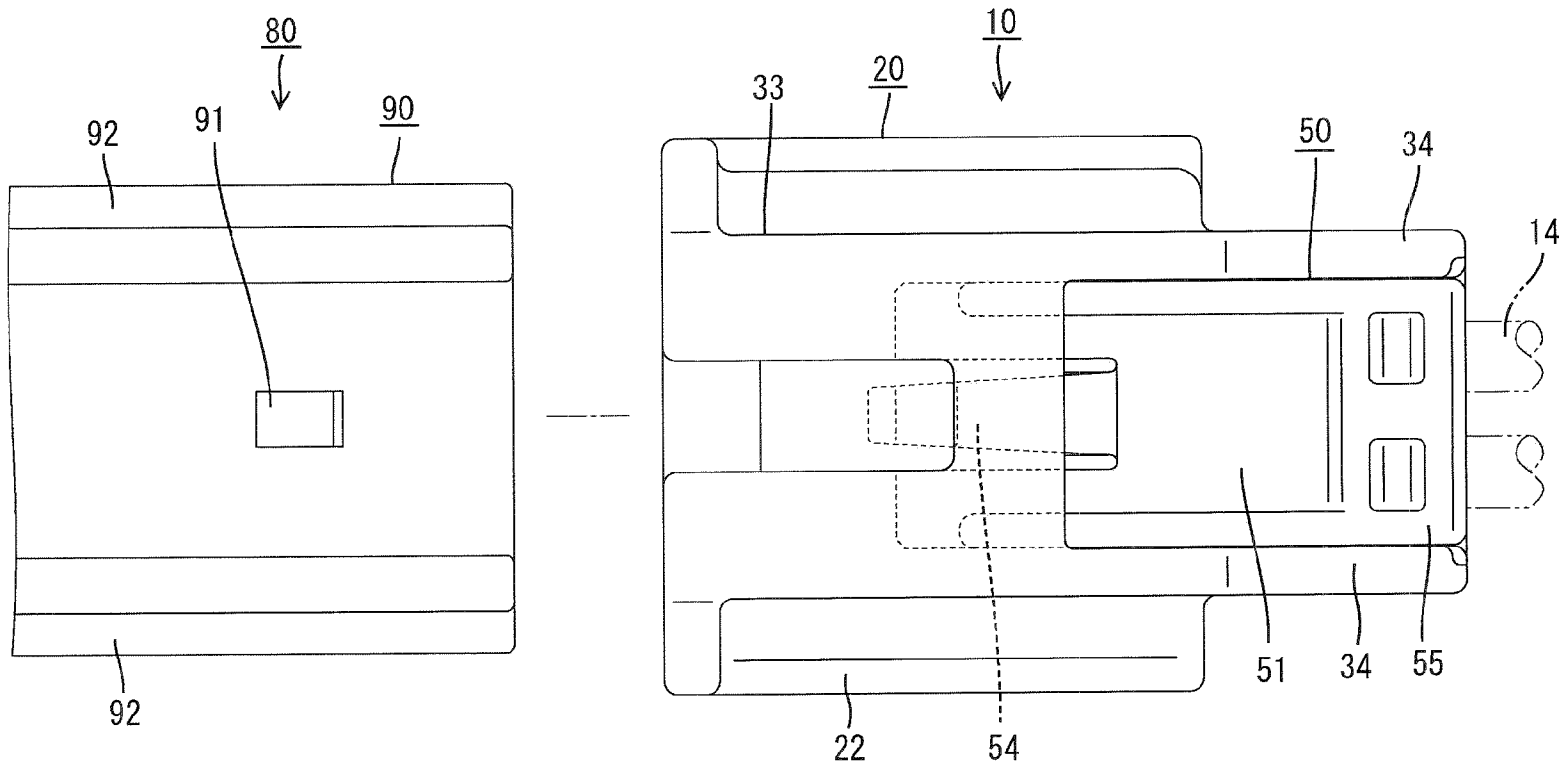
FIG. 1 is a plan view showing a state before a mating connector is fit in a housing of the invention.
Figure 2:
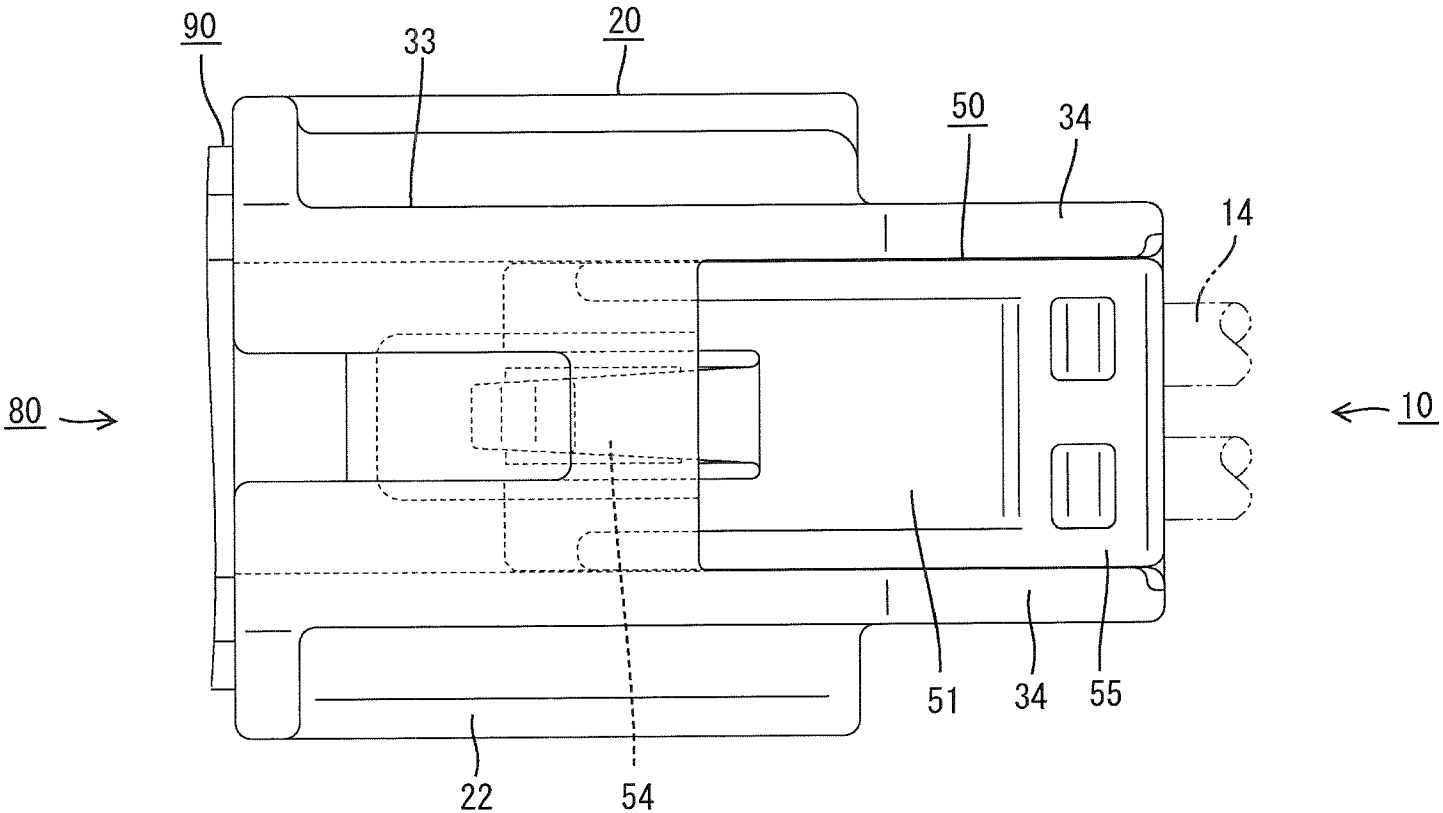
FIG. 2 is a plan view showing a state in which the mating connector has been normally fitted in the housing.
Figure 3:
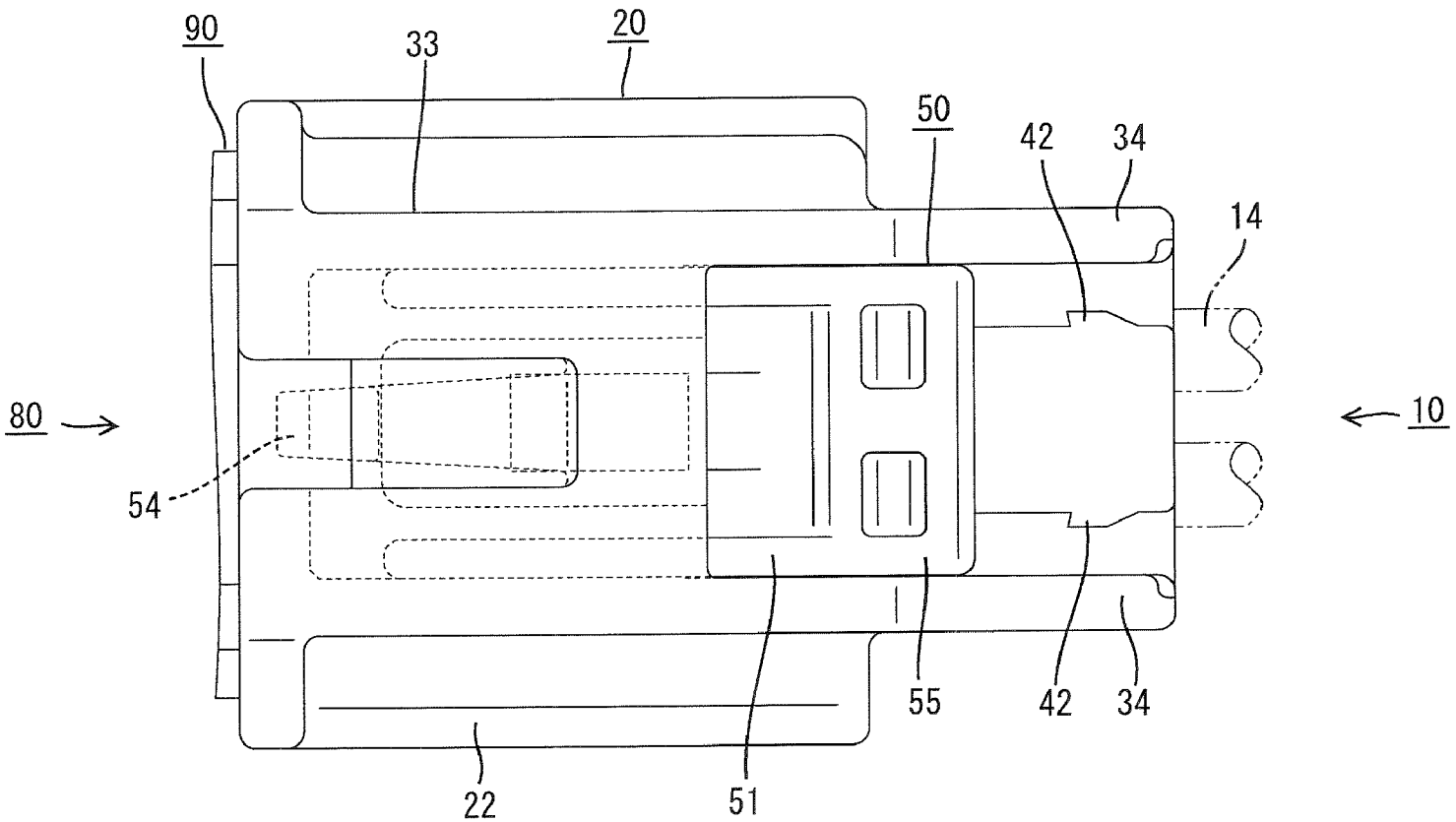
FIG. 3 is a plan view showing a state in which a slider is pressed to a detection position.

A connector 10 in accordance with the invention is identified generally by the numeral 10 in FIGS. 1 through 3. The connector 10 has a housing 20 for receiving a mating connector 80. The end of the housing 20 that receives the mating connector 80 is referred to herein as the front and the vertical direction refers to the orientation shown in FIG. 4.

Figure 6:
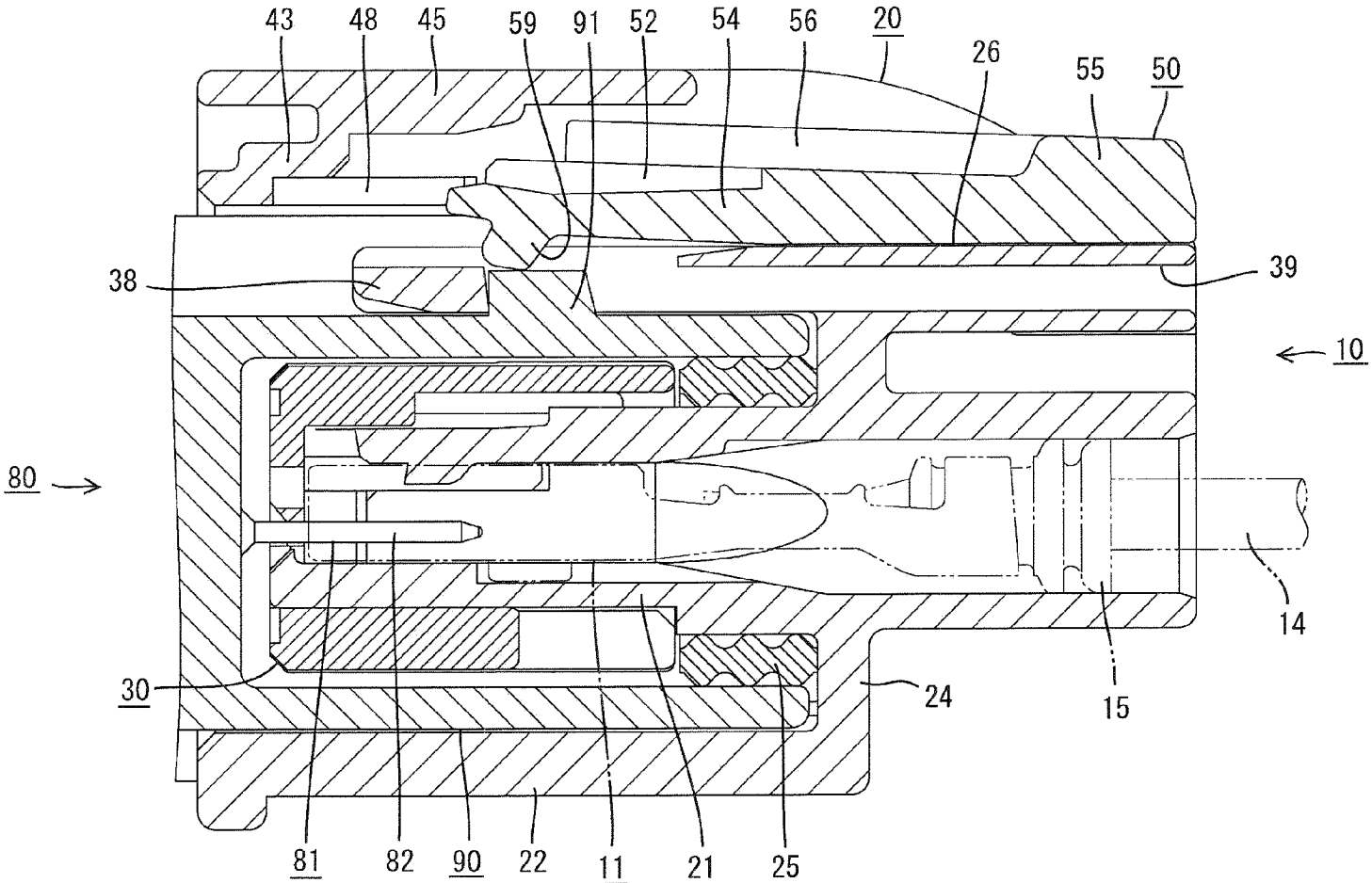
FIG. 6 is a side sectional view showing the housing in which the mating connector is fit normally.

The mating connector 80 has a hood 90 made of synthetic resin and a tab 82 of a male terminal fitting 81 projects inside the hood 90, as shown in FIG. 6. A locking projection 91 is provided on an upper surface of an upper wall of the hood 90, as shown in FIG. 1. Two protection ribs 92 extend in the longitudinal direction of the mating connector at left and right sides of the locking projection 91.

Figure 4:
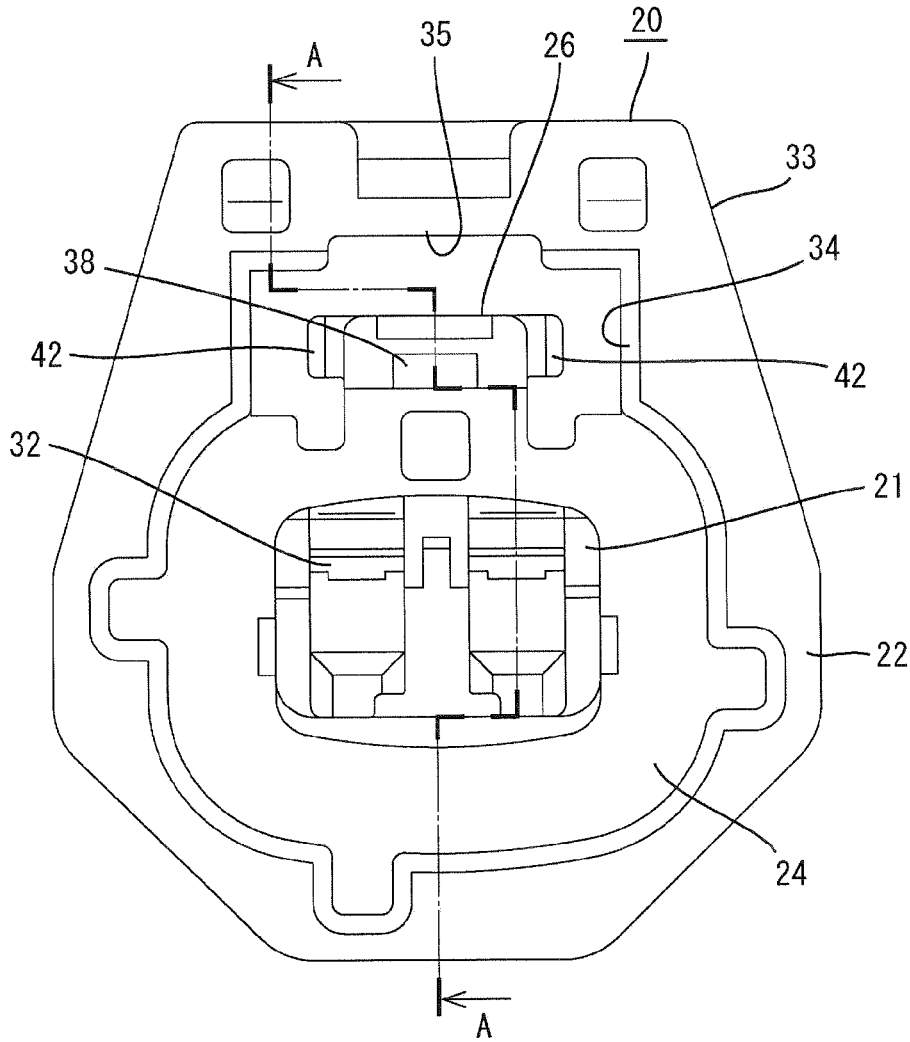
FIG. 4 is a front view showing the housing before the slider is mounted thereon.
Figure 9:
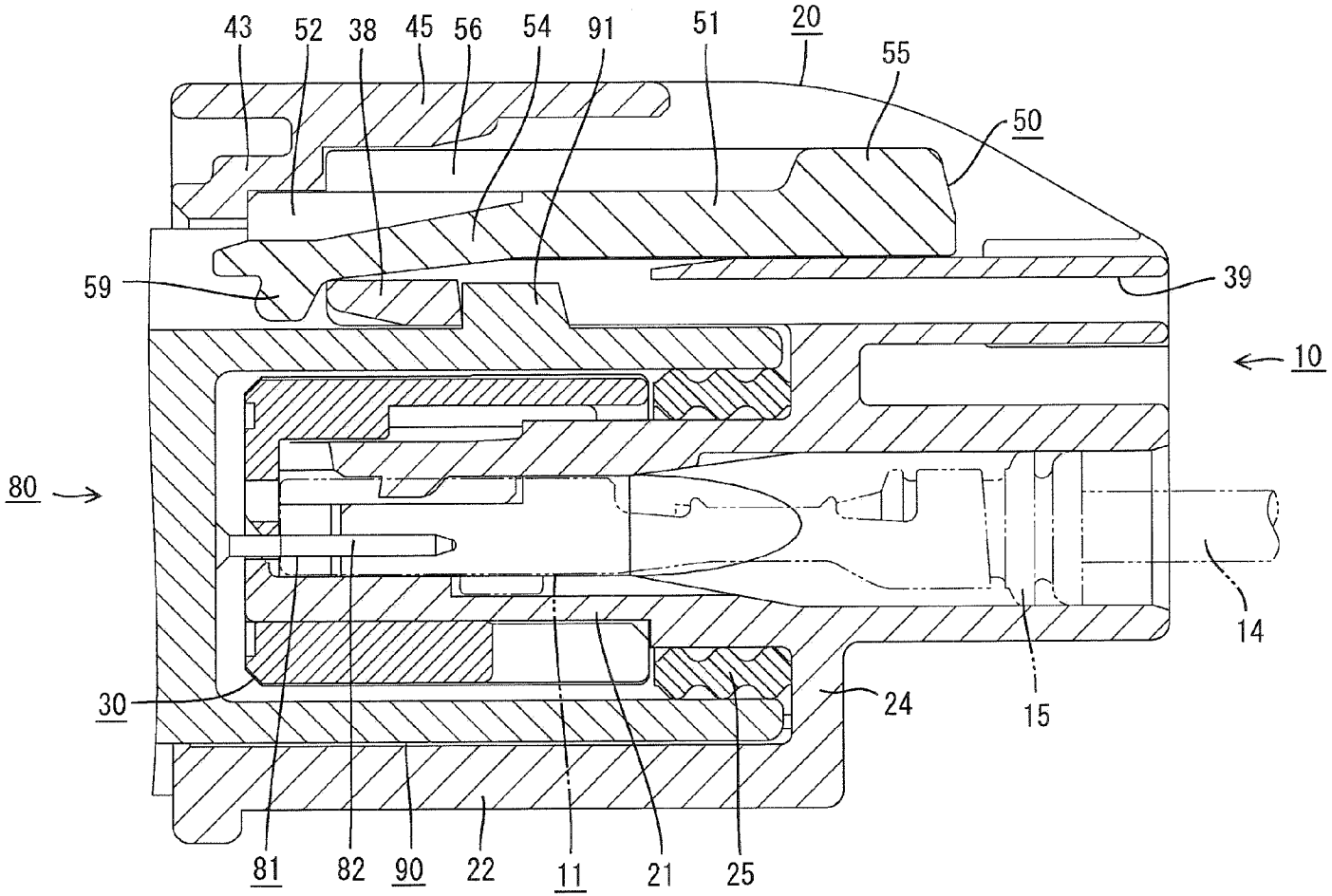
FIG. 9 is a side sectional view showing a state in which the slider has reached the detection position
Figure 10:
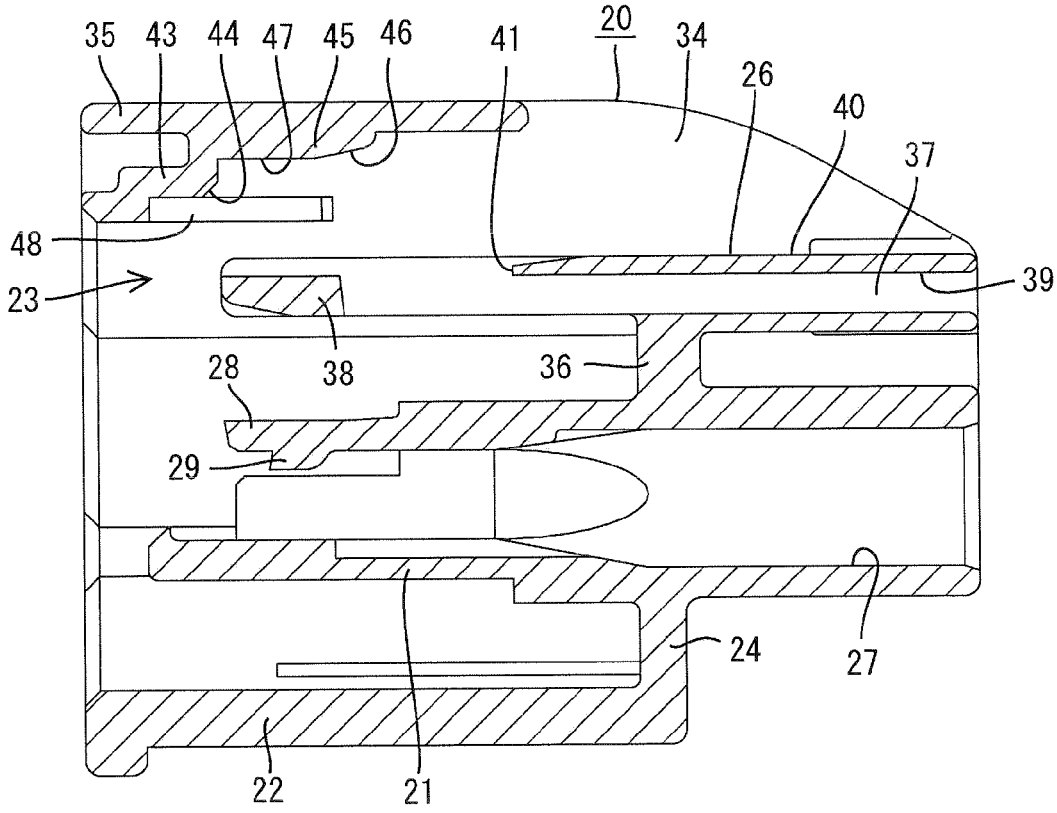
FIG. 10 is a side sectional view showing the housing before the slider is mounted thereon.

The housing 20 is made of synthetic resin. As shown in FIGS. 4 and 10, the housing 20 has a block-shaped terminal accommodation portion 21 that is long in the longitudinal direction. A tubular fit-in portion 22 surrounds the terminal accommodation portion 21. A fit-in space 23 is formed between the terminal accommodation portion 21 and the fit-in portion 22 and can receive the hood 90 of the mating connector 80. A connection portion 24 is provided between the terminal accommodation portion 21 and the fit-in portion 22 at an intermediate portion of the terminal accommodation portion 21 in the longitudinal direction. As shown in FIG. 9, a seal ring 25 is fit at a position immediately before the connection portion 24 and closely contacts an inner surface of the hood 90 of the mating connector 80 in a fit-in state. An elastically deformable locking arm 26 is provided over an upper surface of the terminal accommodation portion 21 and projects in the fit-in space 23.

Two cavities 27 are provided widthwise in the terminal accommodation portion 21 for receiving the female terminal fittings 11. An elastically deformable lance 28 is provided on an inner wall of each cavity 27 by cutting out an upper portion of a front end of the terminal accommodation portion 21. A locking projection 29 is provided on an inner surface of each lance 28 and is locked elastically to a lance hole 12 (see FIG. 5) of the female terminal fitting 11 to prevent removal of the female terminal fitting 11. The female terminal fitting 11 has a known construction with a tubular box 13 at a front portion of the female terminal fitting 11. The lance hole 12 is formed in the tubular box 13. A barrel 16 is formed at a rear portion of the female terminal fitting 11 and is caulked to an end of an electric wire 14, together with a rubber stopper 15.

A front retainer 30 is mounted on and covers a front end of the terminal accommodation portion 21. Tab insertion holes 31 (see FIG. 5) are formed through the front wall of the front retainer 30 at positions corresponding to the cavities 27 for receiving the tabs 82. A flexure prevention portion 32 (see FIGS. 4 and 5) projects rearward on the front wall of the front retainer 30.

The flexure prevention portion 32 advances into a flexible space of the lance 28 when the front retainer 30 is mounted on the terminal accommodation portion 21 in a predetermined normal depth. The flexure prevention portion 32 prevents the lance 28 from flexing and thus locks the female terminal fitting 11 doubly.

A protection wall 33 bulges up on an upper portion of the fit-in portion 22. The locking arm 26 is formed on an inner side of the protection wall 33. The protection wall 33 has longitudinally extending vertical panels 34 at left and right sides of the locking arm 26 and a covering panel 35 (see FIGS. 4 and 10) connects upper front ends of the vertical panels 34. The protection ribs 92 (see FIG. 1) can be received at the inner side of the protection wall 33 from the front of the housing 20.

Figure 11:
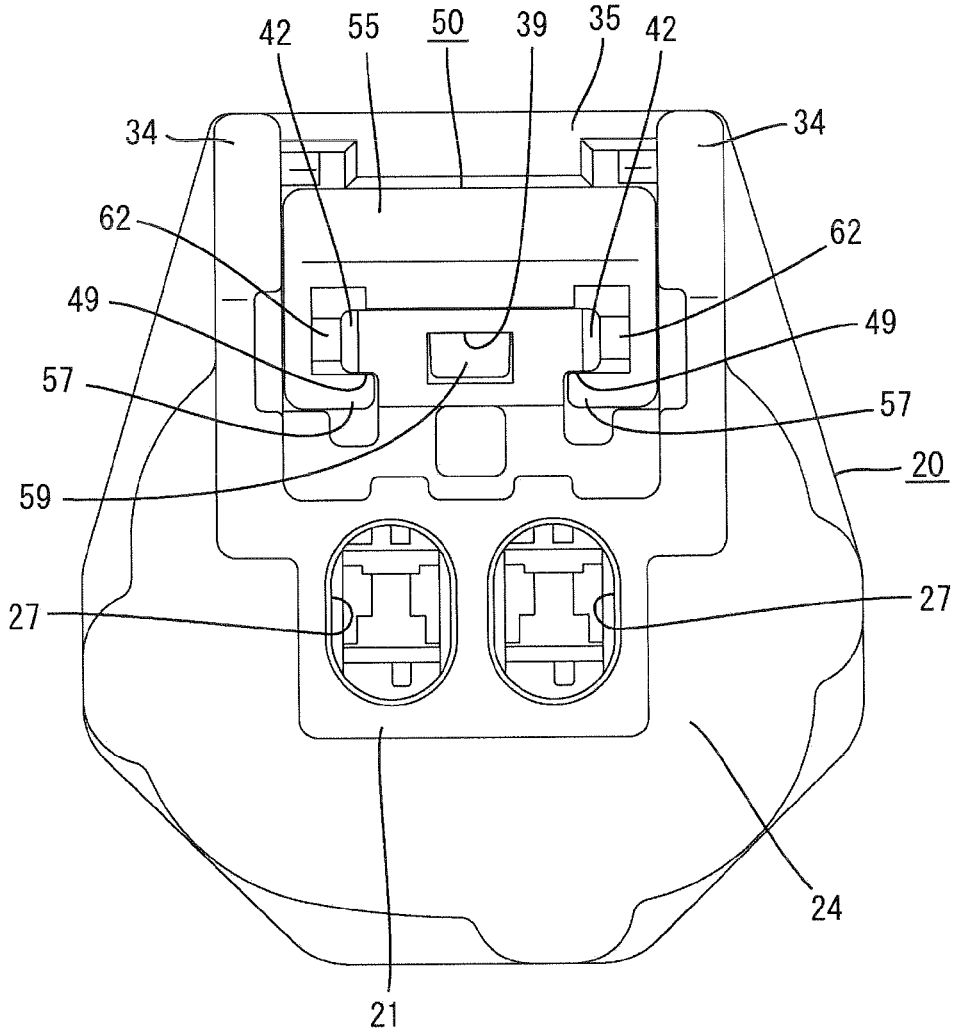
FIG. 11 is a rear view showing the housing.

The locking arm 26 has a supporting leg 36 (see FIG. 19) disposed at the same position as the connection portion 24 in the longitudinal direction of the housing 20 and a long narrow arm 37 extends forward and rearward from an upper end of the supporting leg 36. The arm 37 can swing elastically like a seesaw about the supporting leg 36. A lock 38 is provided at a lower portion of a front end of the locking arm 26. A rearwardly open locking groove 39 is provided rearward from the lock 38 and extends in the longitudinal direction of the housing 20. As shown in FIG. 11, a region of the locking arm 26 rearward from the supporting leg 36 is hollow rectangular tube.

Figure 12:
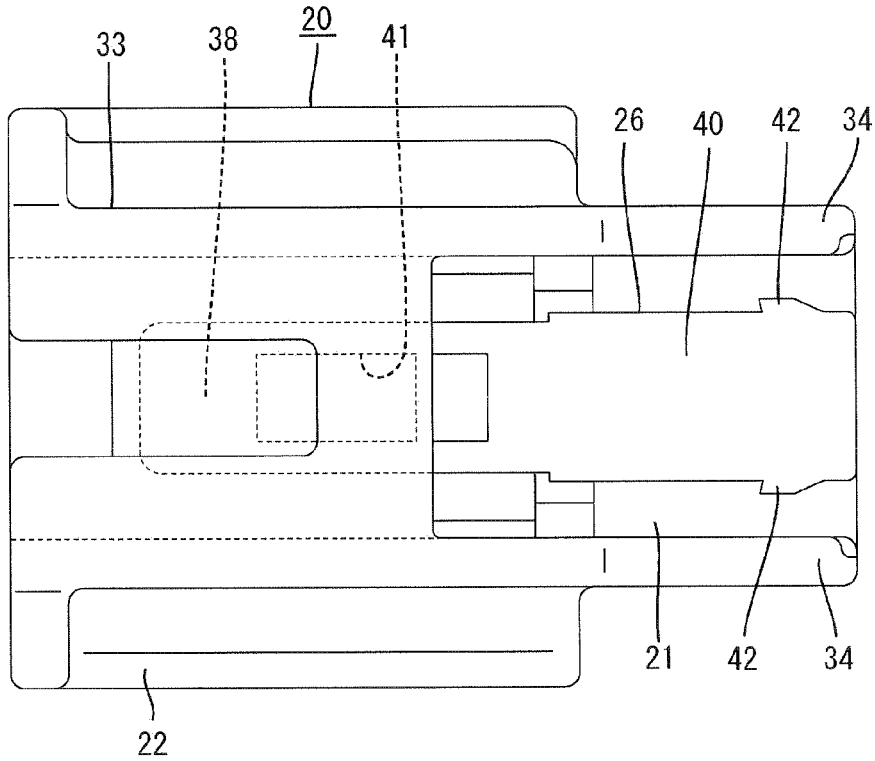
FIG. 12 is a plan view showing the housing before the slider is mounted.

A sliding surface 40 (see FIG. 10) is formed on an approximately rear half of an upper surface of the locking arm 26 and is approximately parallel with a bottom surface of the locking groove 39. A window 41 is formed on an approximately front half of the upper surface of the locking arm 26 and communicates with the locking groove 39. As shown in FIG. 12, two removal prevention pieces 42 project from left and right edges of the sliding surface 40 at a rear portion of the locking arm 26.

A prevention portion 43 descends stepwise toward the front of the housing 20 at left and right sides of a front portion of the covering wall 35. A tapered surface 44 (see FIG. 10) is formed at a stepped portion at a rear end of the prevention portion 43 and inclines down toward the front of the housing 20.

A guide 45 projects on an inner surface of the front portion of the covering wall 35 and has a thickness that increases gradually forward, as shown in FIG. 10. The guide 45 has a guide surface 46 that is continuous with the inner surface of the covering wall 35 and inclines curvedly. A flat surface 47 is approximately horizontally continuous with a front end of the guide surface 46. A front end of flat surface 47 of the guide 45 is continuous with an upper end of the prevention portion 43. Steps are formed on the inner surface of the front end of the covering wall 35. Two prevention ribs 48 project in small amounts from the inner surface of the vertical panels 34 of the protection wall 33 and extend in the longitudinal direction of the housing 20 at positions spaced from the guide 45. The front ends of the prevention ribs 48 are continuous with the lower surface of the prevention portion 43.

Figure 13:
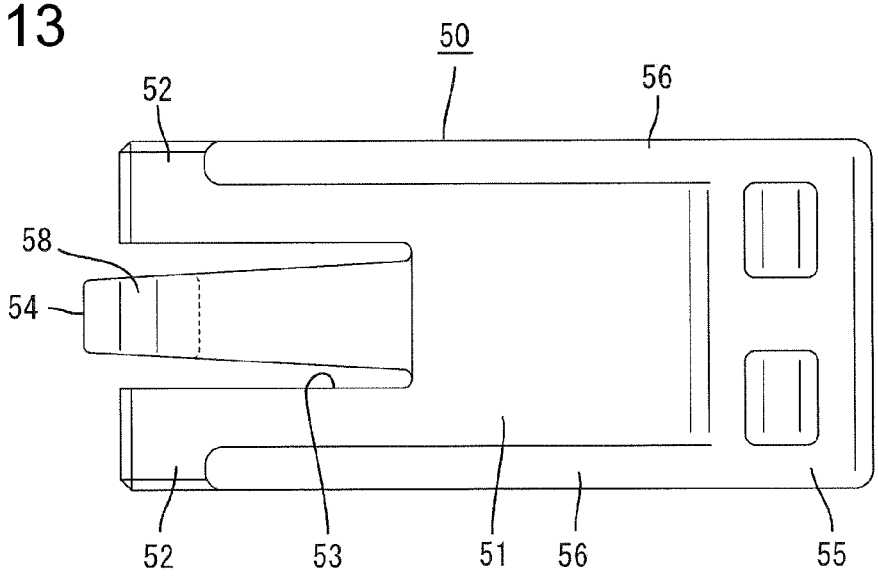
FIG. 13 is a plan view showing the slider.
Figure 14:
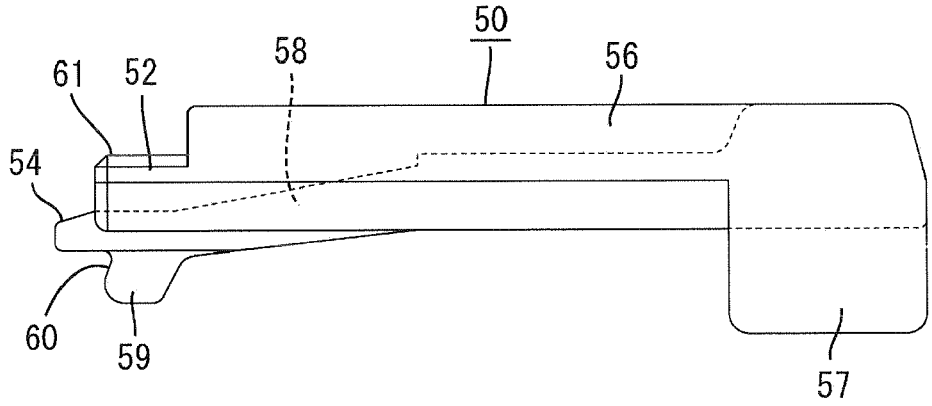
FIG. 14 is a side view showing the slider.
Figure 15:
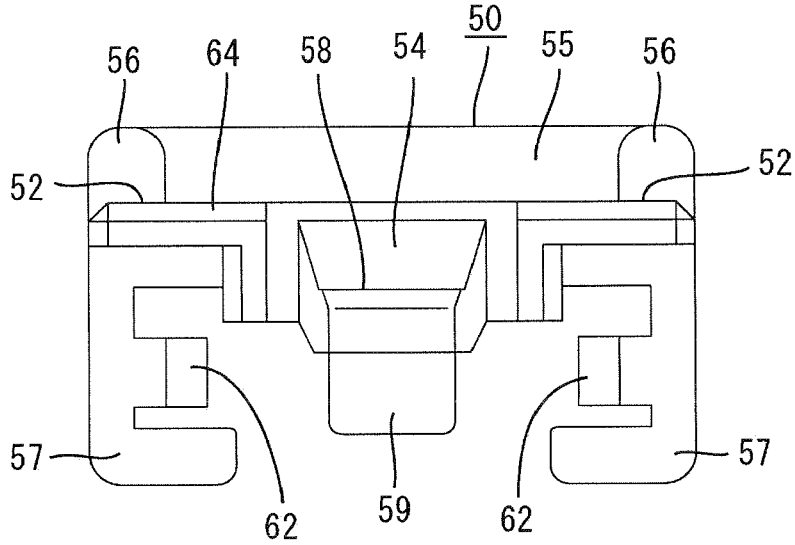
FIG. 15 is a front view showing the slider.

The connector 10 also includes a generally plate-shaped slider 50 that is made of synthetic resin. The slider 50 is mounted on the locking arm 26 and is movable in the longitudinal direction of the housing 20 along the sliding surface 40 of the locking arm 26. More specifically, as shown in FIGS. 13 through 15, the slider 50 has a main body 51 that extends in the longitudinal direction of the slider 50. Two projected pieces 52 are bifurcated at a front end of the main body 51. A concavity 53 is formed between the projected pieces 52 and detection piece 54 projects parallel with the projected pieces 52 from a rear end of the concavity 53. An operation portion 55 projects on an upper rear end of the main body 51, two engaging portions 56 extend forward from left and right sides of the operation portion 55 along left and right edges of the main body 51, and two holders 57 project from left and right sides of a lower portion of the rear end of the main body 51.

Figure 5:
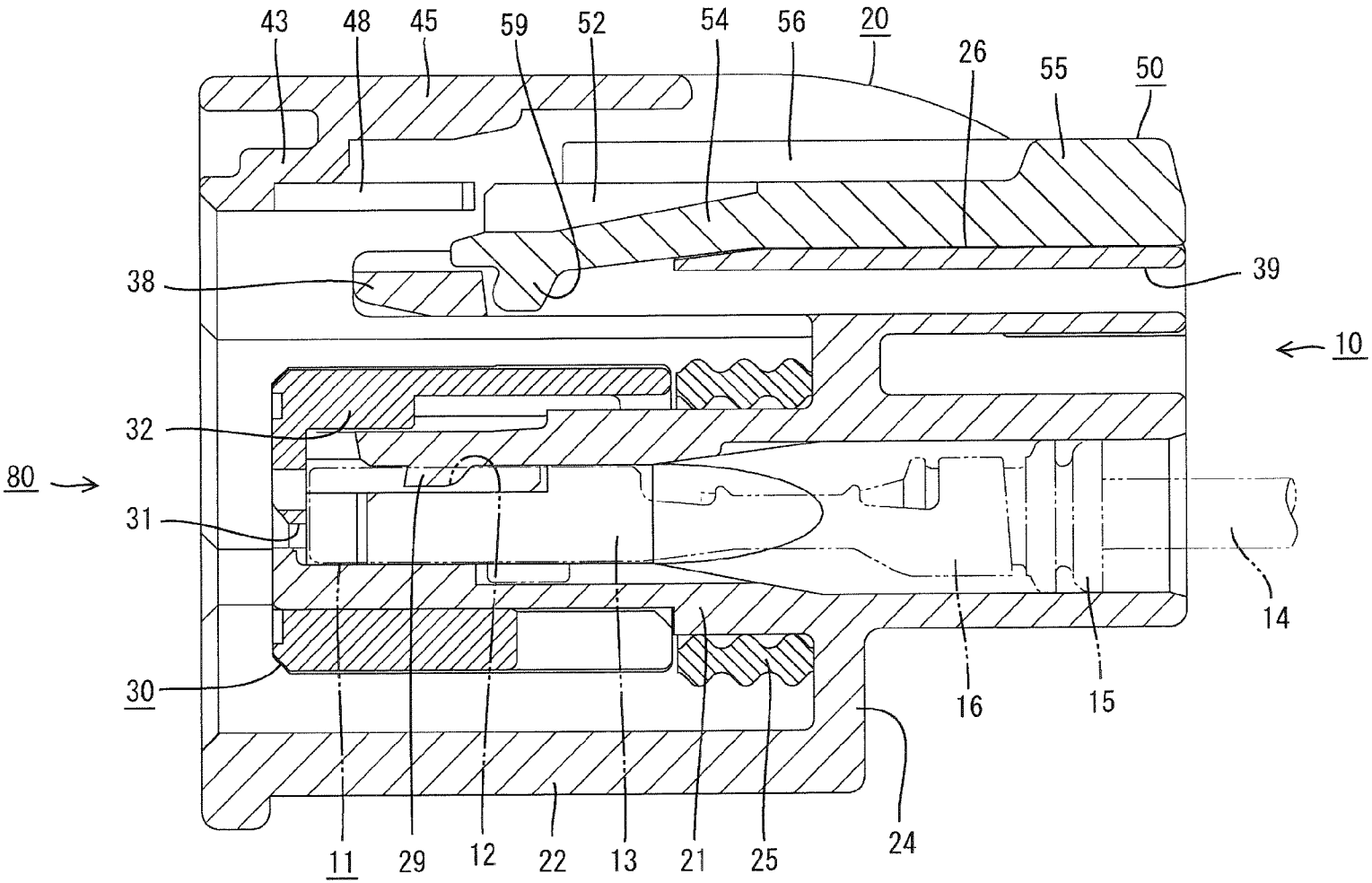
FIG. 5 is a side sectional view taken along a line A-A of FIG. 4 after the slider is mounted on the housing.

The projected piece 52 is cross-sectionally L-shaped and has a vertical plate that is approximately parallel with the detection piece 54. A chamfer 64 is formed at a front end of the projected piece 52 for guiding the projected piece 52 to the lower surface of the prevention portion 43. The detection piece 54 has a main body 58 that extends in the longitudinal direction of the slider 50 and a stop 59 that projects from a lower surface of a front end of the main body 58. The main body 58 is vertically elastically deformable about a rear end of the concavity 53. An overhung stop surface 60 projects forward from a front surface of the stop 59. The detection piece 54 descends from the front portion of the main body 58 in a natural state. The front portion of the detection piece 54 advances through the window 41 and into the locking groove 39 when the slider 50 is at a wait position on the housing 20, as shown in FIG. 5. However, the front portion of the detection piece 54 hangs over the front portion of the locking arm 26 from above when the slider 50 is at a detection position on the housing 20, as shown in FIG. 9.

The operation portion 55 is formed over the entire width of the main body 51 so that an upper end of the operation portion 55 is continuous and flush with an upper end of the engaging portion 56. The left and right engaging portions 56 are longitudinally narrow ribs and are slidable on the guide surface 46 of the guide 45 of the housing 20 during a movement of the slider 50. The portion of the slider 50 between a front surface of the engaging portion 56 and an upper surface of the projected piece 52 has an approximately L-shape that conforms to the step of the prevention portion 43 of the housing 20. This portion fits on the step of the prevention portion 43 when the slider 50 has reached the detection position. A prevention receiving surface 61 is formed on the top of the projected piece 52 forward from the front surface of the engaging portion 56 and is capable of contacting the prevention portion 43 in the vertical direction.

The left and right holders 57 are approximately L-shaped and are mounted to embrace the rear part of the locking arm 26 from the left and right sides thereof. Removal prevention receiving portions 62 project from the inner surface of a vertical plates of the holders 57 and can be locked to the removal prevention piece 42. A rear surface of the removal prevention receiving portion 62 is overhung, i.e., retreats toward its projected end. At the wait position, the rear surface of the removal prevention receiving portion 62 confronts a front surface of the removal prevention piece 42 in a slider removal direction. A slide concavity 49 (see FIG. 11) is formed at left and right sides of the lower portion of the rear end of the locking arm 26 and can receive a crosswise plate of the holder 57.

The slider 50 is mounted on the housing 20 from the rear to a position up from the locking arm 26 and inside the protection wall 33. The stop 59 slides on the sliding surface 40 of the locking arm 26 and elastically flexes the main body 58 of the detection piece 54 in the process of mounting the slider 50 on the housing 20,. The main body 58 of the detection piece 54 returns to its original state when the slider arrives at the wait position, and the stop 59 of the detection piece 54 advances into the locking groove 39 from the window hole 41 so that the stop surface 60 of the stop 59 confronts the rear surface of the lock 38, as shown in FIG. 5. As a result, the slider 50 is prevented from moving forward to the detection position. The crosswise plate of the holding portion 57 fits in the concavity 49 of the locking arm 26 in a normal depth when the slider 50 arrives at the wait position. Accordingly, the slider 50 cannot move up, and the removal prevention receiving portion 62 is locked elastically to the removal prevention piece 42 to prevent the slider 50 from moving rearward in the removal direction.

In the wait state, the engaging portions 56 of the slider 50 are rearward of the guide 45, as shown in FIG. 5. Additionally, the front end of the projected piece 52 of the slider 50 is rearward from the prevention portion 43 and the prevention ribs 48 at a certain interval. At the wait position, the front portion of the slider 50 is surrounded by the protection wall 33, as shown in FIG. 1, and the portion of the slider 50 rearward from the front portion is exposed without being covered by the covering wall 35. Furthermore, the rear end of the slider 50 and the rear end of the housing 20 are at the same longitudinal position.

The seal ring 25 is fit on the terminal accommodation portion 21 of the housing 20, and then the front retainer 30 is mounted on the terminal accommodation portion 21 from the front. The female terminal fitting 11 then is inserted into the cavity 27 from the rear and is locked primarily to the lance 28. Next, the front retainer 30 is pressed to a normal mounting position to secondarily lock the female terminal fitting 11 to the flexure prevention portion 32 of the front retainer 30.

In this state, the terminal accommodation portion 21 of the housing 20 is fit in the hood 90 of the mating connector 80. The lock 38 rides over the locking projection 91 of the mating connector 80 in the process of fitting the terminal accommodation portion 21 in the hood 90. Thus, the locking arm 26 swings like a seesaw. The lock 38 rides across the locking projection 91 when the terminal accommodation portion 21 is fit in the hood 90, and the locking arm 26 makes a reciprocating motion. The slider 50 follows the movement of the locking arm 26 and also is displaced. The locking projection 91 fits in the locking groove 39 when the mating connector 80 and the housing 20 have been fit together properly, as shown in FIG. 6. As a result, the locking projection 91 confronts the rear surface of the lock 38 to hold the housing 20 and the mating connector 80 in a fit-in state with the female terminal fitting 11 connected electrically with the male terminal fitting 81. Additionally, the locking projection 91 presses the stop 59 out as the locking projection 91 fits in the locking groove 39. Thus, the detection piece 54 flexes elastically up and the stop 59 rides over the upper surface of the locking projection 91.

Figure 7:
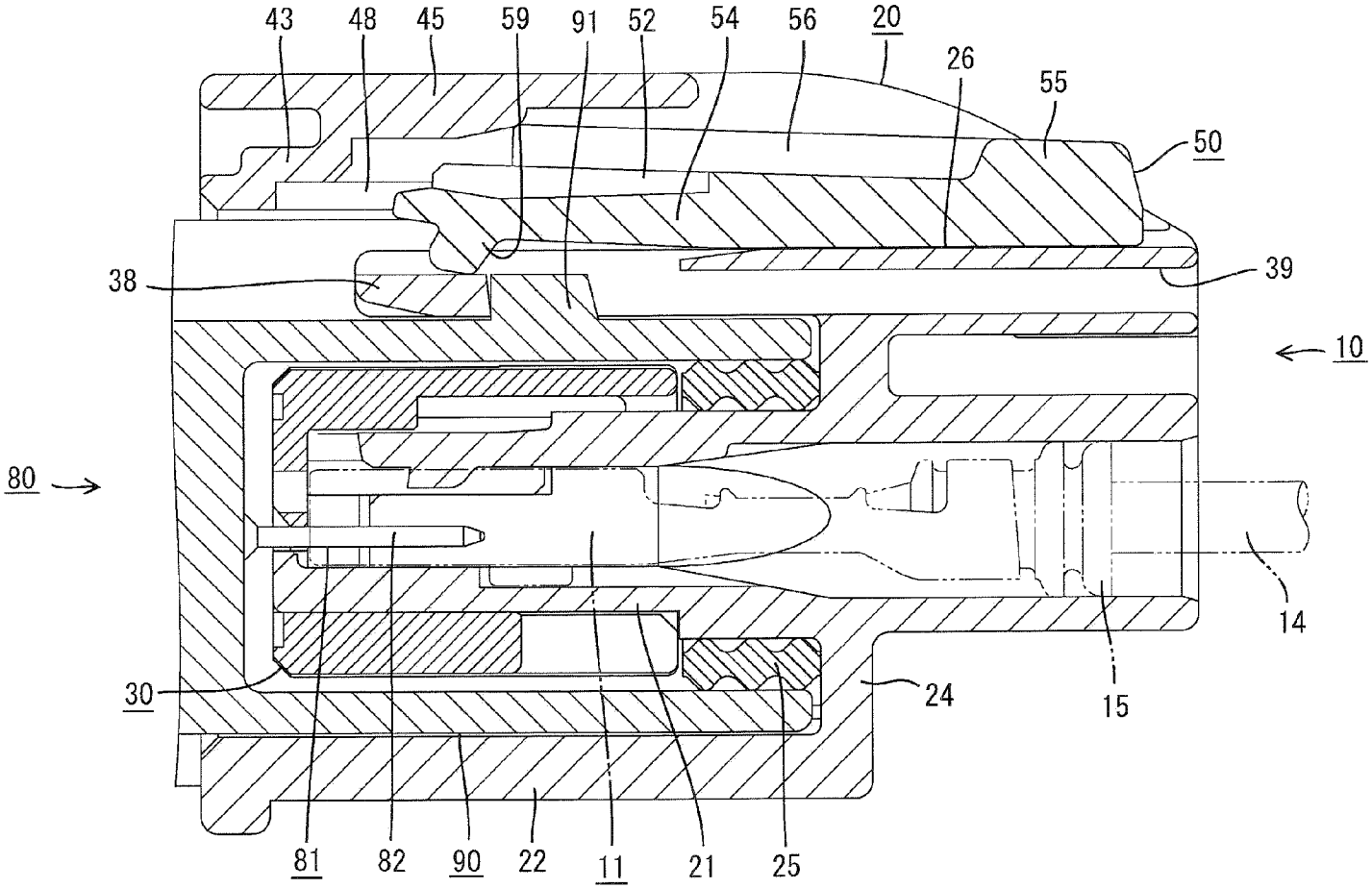
FIG. 7 is a side sectional view showing a state in which the slider is moving to the detection position.
Figure 8:
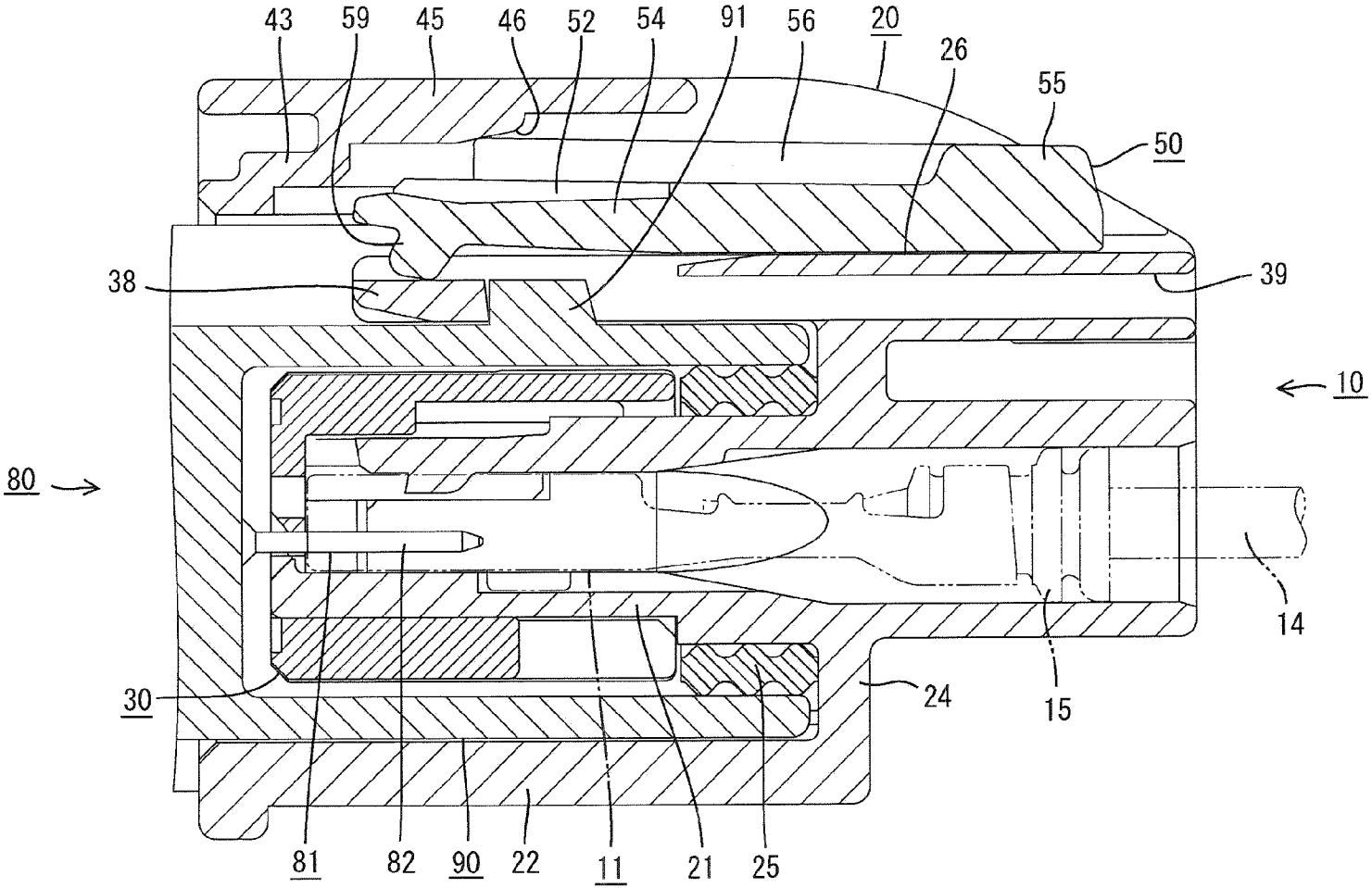
FIG. 8 is a side sectional view showing a state before the slider reaches the detection position.

The operation portion 55 of the slider 50 is gripped and the slider 50 is moved forward to the detection position, as shown in FIGS. 2 and 3, when the stop 59 is unlocked from the lock 38. The detection piece 54 remains flexed in the process of moving the slider 50 to the detection position and the stop 59 slides from the upper surface of the locking projection 91 to the upper surface of the lock 38, as shown in FIGS. 7 and 8. Further, the engaging portions 56 of the slider 50 slide on the guide surface 46 of the guide 45 in the process of moving the slider 50 to the detection position. Thus, the slider 50 gradually displaces obliquely down toward the front and in a direction in which the degree of locking between the slider 50 and the locking arm 26 increases. At this time, a thin portion of the locking arm 26 at the rear between the bottom surface of the locking groove 39 and the sliding surface 40 flexes elastically down a small amount to allow the oblique displacement of the slider 50. In the process of moving the slider 50 to the detection position, the left and right edges of the slider 50 slide on the inner surfaces of the vertical panels 34 of the housing 20 to prevent a free movement of the slider 50 in a widthwise direction.

The engaging portions 56 shift from the guide surface 46 of the guide 45 to the flat surface 47 immediately before the slider 50 reaches the detection position. Additionally, the front of the projected piece 52 slips below the prevention portion 43 with the left and right edges of the projected piece 52 sliding on the prevention guide portion 48. Corners of the front ends of the engaging portions 56 fit in the step between the guide 45 and the prevention portion 43 when the slider 50 reaches the detection position, as shown in FIG. 9, and a corner of the front end of the projected piece 52 fits on the step of the prevention portion 43. Thus the lower surface of the prevention portion 43 and the prevention receiving surface 61 of the projected piece 52 contact each other in the vertical direction. As a result, the slider 50 cannot displace forward or up. Thus, the locking arm 26 is locked to the locking projection 91 and cannot be displaced elastically. The detection piece 54 returns to its original state when the slider 50 reaches the detection position. More particularly, the front part of the slider 50 elastically returns to the original downwardly inclining posture, and the front part of the stop 59 moves to a position forward from the front surface of the lock 38. The stop 59 presses the front portion of the locking arm 26 down from above. Thus the locking arm 26 and the locking projection 91 are locked to each other to a high extent. When the slider 50 reaches the detection position, as shown in FIG. 3, a greater part (including the operation portion 55, other than the rear portion) of the main body 51 of the slider 50 is inserted into the protection wall 33 and shielded from the outside.

Movement of the housing 20 could be stopped immediately before the mating connector 80 is fit in the housing 20 in the normal state. However, in this situation, the locking projection 91 will not be fit in the locking groove 39 of the locking arm 26. Thus, the stop 59 and the lock 38 remain locked together to prevent the slider 50 from being moved to the detection position. Therefore the inability to move the slider 50 to the detection position indicates that the housing 20 is in an incomplete fit-in state. In this case, the mating connector 80 is pushed into the housing 20 sufficiently to achieve the normal fit-in state.

As apparent from the foregoing description, the guide 45 allows a gradual increase in the degree of the locking between the slider 50 and the locking arm 26 as the slider 50 moves to the detection position. Therefore the slider 50 is guided correctly to the detection position. Further, the locked state between the locking arm 26 and the locking projection 91 is held securely and firmly when the slider 50 reaches the detection position.

The front part of the detection piece 54 inclines down and presses the locking arm 26 down when the slider 50 is at the detection position. Therefore it is possible to hold the locking state between the locking arm 26 and the locking projection 91 more securely and firmly.

The prevention portion 43 and the guide

45 are continuous with each other. Thus, the slider 50 can be shifted smoothly from the prevention portion 43 to the guide portion 45. Further the prevention portion 43 securely prevents an inadvertent elastic flexure of the locking arm 26.

The protection wall 33 covers front portion of the slider 50 when the slider 50 is at the wait position. Thus, the protection wall 33 prevents the slider 50 from being damaged by foreign matter and prevents the slider 50 from being moved inadvertently to the detection position.

The invention is not limited to the embodiment described above with reference to the drawings. For example, the following embodiments are included in the technical scope of the present invention.

The above-described guide surface inclines in the direction in which the degree of the locking between the slider moving to the detection position and the locking arm becomes high. However, it is possible to provide the engaging portion of the slider with the guide surface that inclines in the direction in which the degree of the locking between the slider moving to the detection position and the locking arm becomes high.

The detection piece of the slider may be horizontal instead of taking the downwardly inclining posture at its front in the natural state or at the detection position.

The slider may be entirely disposed in exposure at the wait position.

Instead of the front retainer, the housing may be provided with a side retainer that is mounted on a side surface thereof.

The locking arm and the slider may be mounted on a male connector housing where the male terminal fitting can be mounted.

The construction is applicable to a non-waterproof connector.

What is claimed is:

1. A connector comprising:

a housing configured to receive a mating connector a locking arm formed on the housing and configured to flex elastically in a process of fitting the mating connector in said housing and to return elastically when said mating connector is fit normally in said housing for holding said mating connector in a separation prevention state;

a slider mounted on said housing and movable between a wait position and a detection position, said slider being locked to said locking arm and held at said wait position in a process of fitting said mating connector in said housing and being unlocked from said locking arm and permitted to move to said detection position when said mating connector is fit normally in said housing said slider being disposed at a position opposite to a flexing direction of said locking arm when said slider is at said detection position to prevent said locking arm from flexing in an unlocking direction, wherein said housing has a guide that slides on said slider during a movement of said slider and gradually displaces said slider to said detection position in a direction in which a degree or amount of locking between said slider and said locking arm becomes higher.

2. The connector of claim 1, wherein said slider has an elastically flexible detection piece a front portion of said detection piece being inclined downwardly at said detection position and pressing said locking arm.

3. The connector of claim 2, wherein the guide is slanted for urging the slider in the direction in which a degree of locking between said slider and said locking arm becomes higher.

4. The connector of claim 3, wherein the slider has engaging portions with front corners chamfered for sliding engagement with the guide of the housing.

5. The connector of claim 4, wherein the engaging portions are disposed on opposite respective sides of the detection piece.

6. The connector of claim 1, wherein said housing has a prevention portion continuous with said guide and engaging said slider when said slider has reached said detection position to prevent said slider from moving up and preventing said locking arm from elastically flexing in said unlocking direction.

7. The connector of claim 1, wherein said housing has a protection portion covering a front part of said slider when said slider is at said wait position.

8. A connector assembly comprising:

a mating connector with a hood having a locking projection formed thereon;

a housing with a front end configured to receive the mating connector and a rear end opposite the front end, a locking am formed on the housing and configured to be deflected by the locking projection in a process of fitting the mating connector in the housing and to return elastically when the mating connector is fit normally in the housing (20) for holding the locking projection a guide formed on the housing outwardly from the locking arm and being slanted to face rearwardly and inwardly on the housing; and a slider mounted on the locking arm movement between a wait position and a detection position, the slider a resiliently deflectable detection piece engaged with the lock arm, for holding the slider releasably at the wait position the detection piece being disposed for engagement by the locking projection during connection of the mating connector with the housing for releasing the slider from the wait position and enabling the slider to move toward the detection position when said mating connector is fit normally in said housing, wherein the guide of the housing and the slider engage during a movement of the slider for gradually displacing the slider to the detection position and in a direction in which a degree or amount of locking between the slider and the locking arm becomes higher.

9. The connector assembly of claim 8, wherein the slider has engaging portion with front corners chamfered for sliding engagement with the guide of the housing.

10. The connector assembly of claim 4, wherein the engaging portion are disposed on opposite respective sides of the detection piece.

* * * * *